US011815339B2

(12) United States Patent
Gokkel

(10) Patent No.: US 11,815,339 B2
(45) Date of Patent: Nov. 14, 2023

(54) PROTECTIVE SHIELD

(71) Applicant: Paul Gokkel, Utrecht (NL)

(72) Inventor: Paul Gokkel, Utrecht (NL)

( * ) Notice: Subject to any disclaimer, the term of this patent is extended or adjusted under 35 U.S.C. 154(b) by 54 days.

(21) Appl. No.: 17/596,003

(22) PCT Filed: Jun. 1, 2020

(86) PCT No.: PCT/NL2020/050352
§ 371 (c)(1),
(2) Date: Dec. 1, 2021

(87) PCT Pub. No.: WO2020/246875
PCT Pub. Date: Dec. 10, 2020

(65) Prior Publication Data

US 2022/0236035 A1 Jul. 28, 2022

(30) Foreign Application Priority Data

Jun. 2, 2019 (NL) ..... 2023247

(51) Int. Cl.
*F41H 5/08* (2006.01)

(52) U.S. Cl.
CPC ..... *F41H 5/08* (2013.01)

(58) Field of Classification Search
CPC ..... F41H 5/08; F41H 5/18
See application file for complete search history.

(56) References Cited

U.S. PATENT DOCUMENTS 4,245,546 A * 1/1981 Chaires ..... F41H 5/08 109/49.5
2019/0174903 A1* 6/2019 Holder ..... A45F 3/06
2022/0408905 A1* 12/2022 Bustos ..... A45F 3/02

* cited by examiner

*Primary Examiner* — J. Woodrow Eldred
(74) *Attorney, Agent, or Firm* — Patshegen IP; Moshe Pinchas

(57) ABSTRACT

The invention relates to a protective shield that can be worn by one person. This shield encloses this person's entire upper body and is made of bullet-resistant or fragment-resistant material. The protection shield consists of two concentric hollow semi-cylindrical or conical halves. The first half has slightly smaller outer dimensions than the second half and includes belts or straps, such that the wearer can carry this first half on his back like a backpack. The second larger half is rotatably mounted on the outside of this first half and can hold 180 rotated degrees about a vertical axis of rotation. The protection shield can also include more than two concentric hollow semi-cylindrical or conical halves.

11 Claims, 6 Drawing Sheets

PROTECTIVE SHIELD

The present invention relates to a protective shield that can be worn by a person.

This shield encloses this person's upper body and is made of unbreakable material, plastic such as polycarbonate or a bullet-resistant material. The person which is surrounded by such a shield is protected against influences such as bullets, shrapnel and blows from the outside, but also against weather influences such as rain and cold. This bullet resistant shield also protects the wearer's arms. There may be extra openings in one or more sides of the shield to allow the arms to pass through.

The shield has the shape of a hollow cap and can completely cover the upper body.

Due to the round shape of the surface, the weight is minimal.

The shield includes straps or a harness on the inside, which is attached and tied to the wearer of the shield.

The protective shield preferably consists of two concentric hollow half cylindrical or conical halves.

The top of each half is slightly rounded and can include a transparent bullet or impact resistant viewing window. The first half has slightly smaller outer dimensions than the second half and includes belts or straps, such that the wearer can carry this first half on his back like a backpack. The second larger half is rotatably mounted on the outside of this first half and can rotate approximately 180 degrees about a vertical axis of rotation.

In this unfolded state the entire upper body of the wearer is covered by the protection shield and the user is optimally protected. This axis of rotation can be designed as a pin/screw through the tops of both halves. The two halves each also comprise one or more circular guides, such that they can support the rotary movement of the second half.

The circular guide of the second half slides into the circular guide of the first half.

Both halves can comprise a sturdy, preferably steel frame, in which curved protective plates can be mounted. These plates can include a metal liner provided with curved ceramic plates and/or bullet-resistant Kevlar or Dyneema plastic panels.

The protective shield can also include more than two concentric hollow cylinder-segment-like or conical halves, such that the protective shield can be folded in more compactly.

Each half can also be composed of two or more semi-cylindrical parts, that can telescopically slide into each other in the vertical longitudinal direction.

Figure 1:
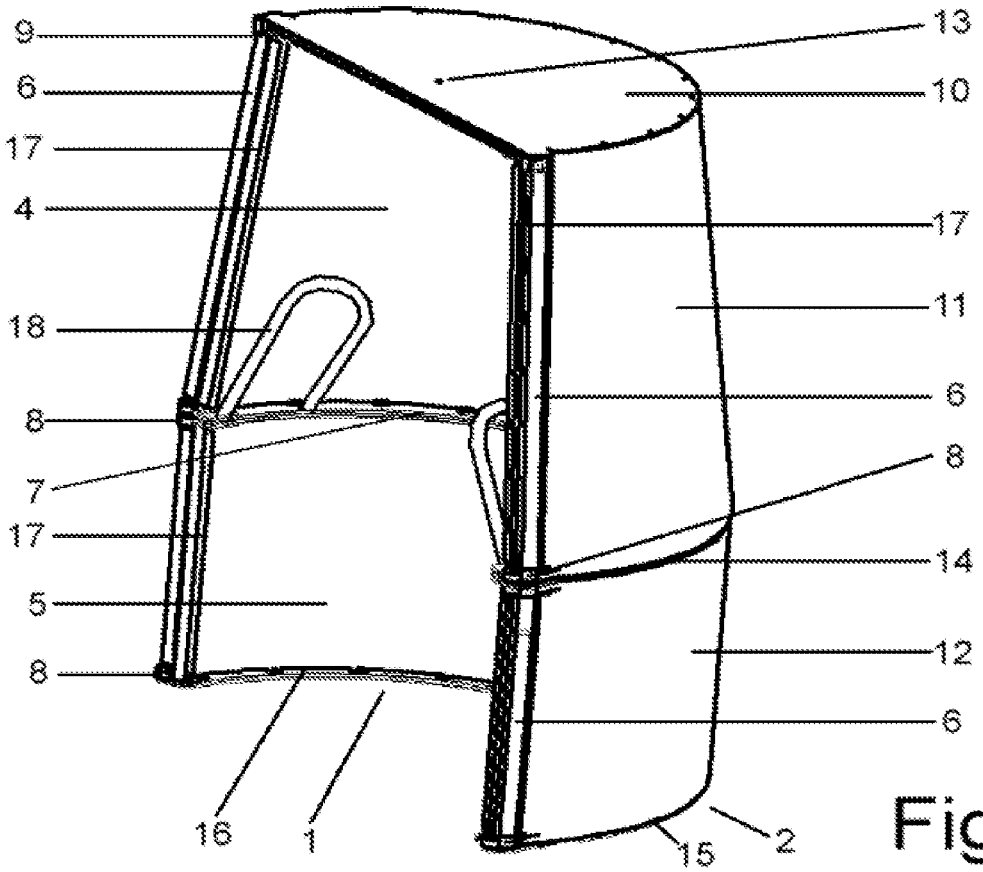

The present invention will be further elucidated here below with reference to the annexed figures of several examples of embodiments:

FIG. 1 shows a preferred embodiment of the invention with an opened protective shield in which the first smaller half 1 is nested entirely within the second larger half 2. Half 1 comprises a cylindrical bottom 5 and a conical top 4. The conical top 4 is closed by a roof (3 in FIG. 2). This roof 3 includes a pin 13, which acts as a vertical rotation axis for the second larger half 2. The cylindrical bottom 5 and conical top 4 of half 1 are composed of a tubular frame of tubes 17 which are connected to circular guidance elements 7 and 16 respectively with tube connectors 8.

Bullet-resistant or fragment-resistant panels can be placed in this tubular frame.

Straps or loops 18 can be mounted on the inside of half 1, allowing the wearer of the protective shield to insert his arms through and the protection shield, in the configuration shown in this figure, can be transported as a backpack.

The half 2 comprises a cylindrical bottom 12 and a conical top 11. The conical top 11 is closed by a roof 10. In this roof 10 is located a pin 13, which functions as a vertical axis of rotation. The cylindrical bottom 12 and the conical top 11 of half 2 are composed of tubular frame of tubes 6 which are fixed to circular guidance elements 14 and 15 with tube connectors 8. In this tubular frame, bullet-resistant or fragment-resistant panels can be placed.

Figure 2:
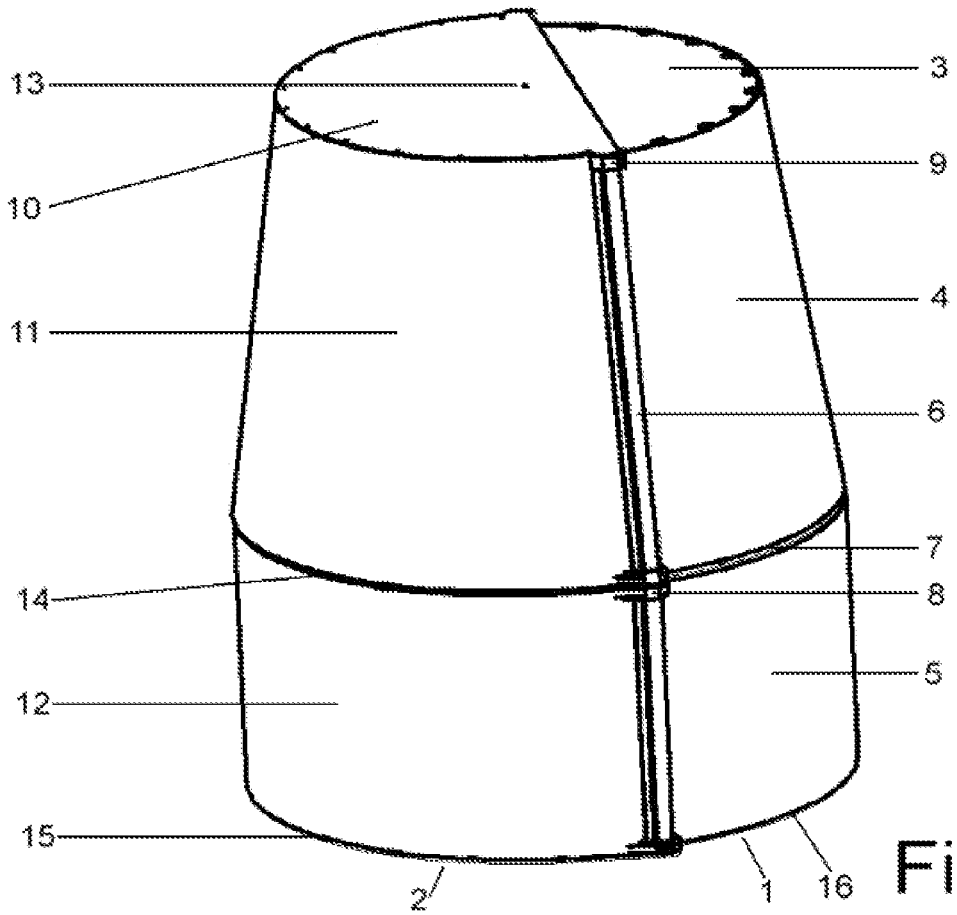

FIG. 2 shows the protection shield with the outer half 2 rotated forward approximately 180 degrees about the vertical axis 13 and in this way a completely closed compartment is realized. The half 1 includes a cylindrical bottom 5 and a conical top 4. The conical top 4 is closed by a roof 3. This roof 3 comprises a pin 13, which acts as a vertical axis of rotation for the second larger half 2. The cylindrical bottom 5 and a conical top 4 of half 1 are composed of a tubular frame of tubes (17 in FIGS. 1 and 3) which are attached to circular guidance elements 7 and 16 respectively, using tube connectors.

Bullet-resistant or fragment-resistant panels can be placed in this tubular frame 17.

The half 2 comprises a cylindrical bottom 12 and a conical top 11. The conical top 11 is closed by a roof 10. In this roof 10 is located a pin 13 that acts as a vertical axis of rotation. The cylindrical bottom 12 and the conical top 11 of half 2 are composed of a tubular frame of tubes 6 which are attached to circular guidance elements 14 and 15 with tube connectors 8. Bullet-resistant or fragment-resistant panels can be inserted in this tubular frame.

Figure 3:
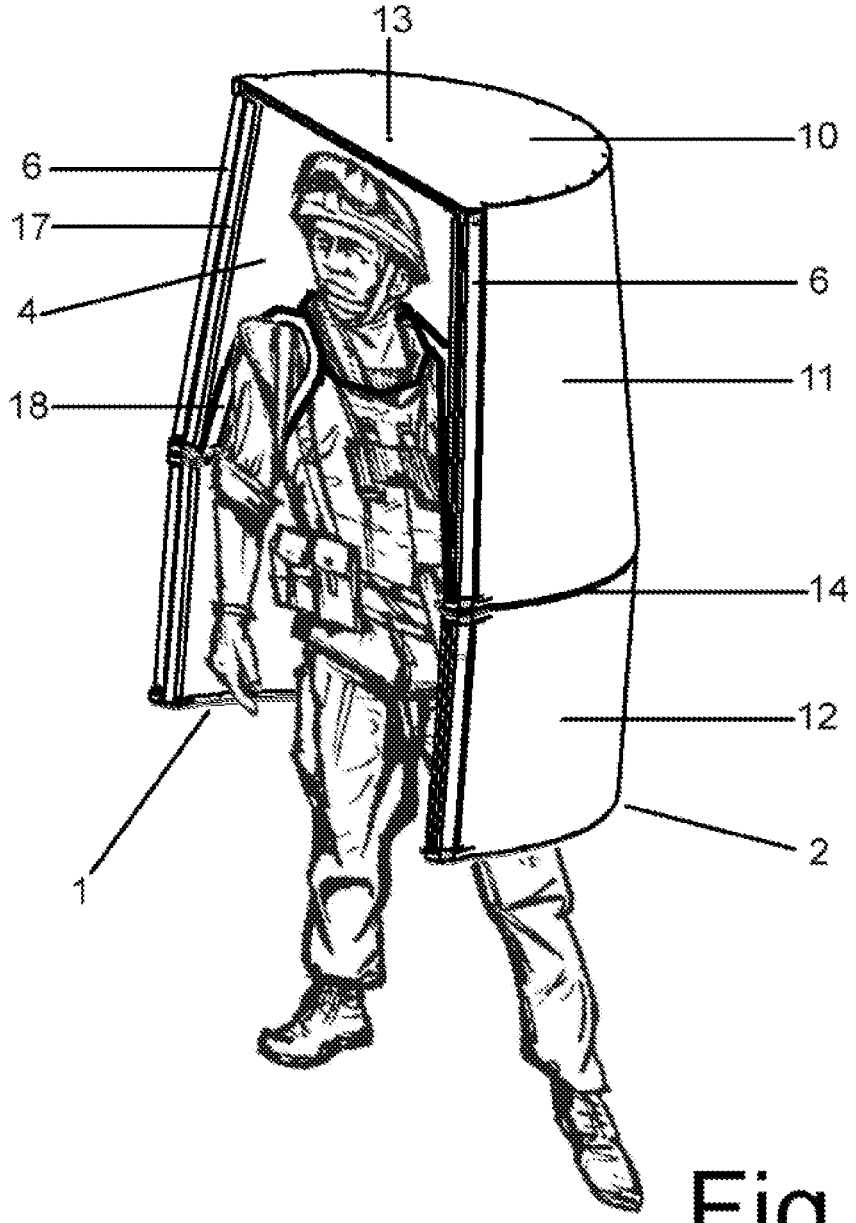

FIG. 3 depicts the method of carrying the protective shield.

In the inner half 1 there are two or more straps or loops 18, which are attached to the inner surface of the inner half 1 of the shield. The wearer of the protective shield can put his arms through these loops 18 and wear the protection shield on his back. In case of bad weather or danger, the wearer can rotate the outer half 2 forward and his upper body is completely covered by the protective shield.

Figure 4:
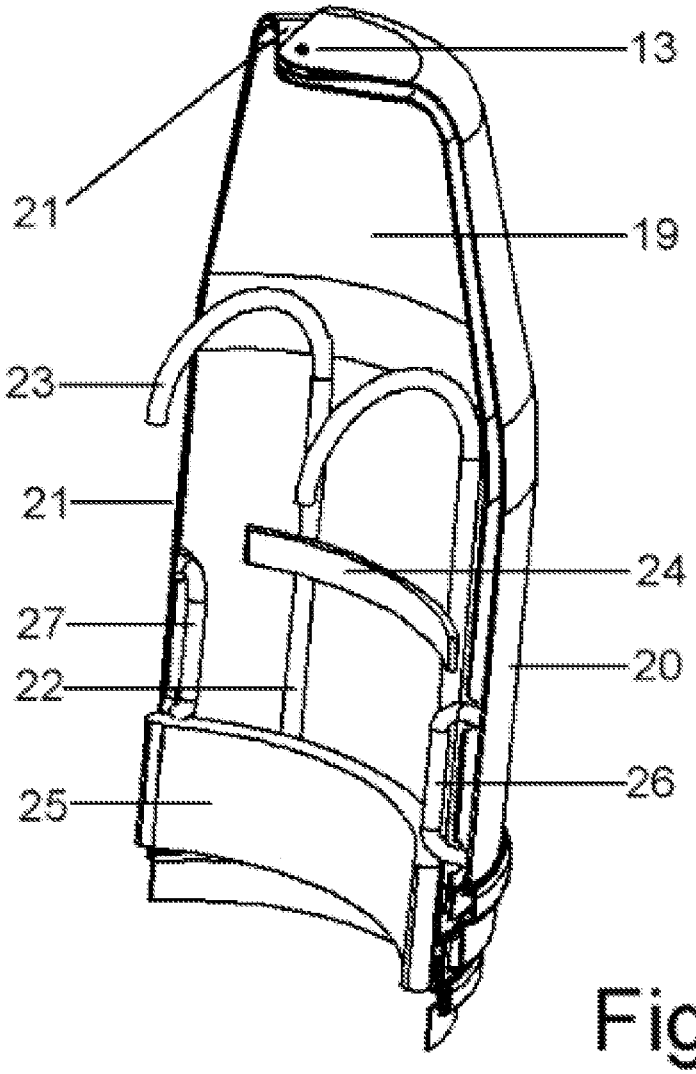

FIG. 4 shows a preferred embodiment of the opened protection shield, which includes three hollow parts, nested into each other and the smallest inner part 19 comprising a harness 22 and the outer two parts 20 and 21 can be rotated forward about the vertical axis 13. Both hollow parts 20 and 21 each comprise a cylindrical bottom and a conical top. The outer hollow part 20 includes a handle 26 and the middle hollow part 21 includes a handle 27 so that the user can move both parts forward in one movement to protect himself quickly. The harness 22 includes at the top two loop-shaped hooks 23, which can rest on the shoulders of the user.

As a result, the user has his arms free and the arms are not burdened by the weight of the shield.

The harness 22 also includes an upper backrest 24 and a lower backrest 25.

The protective cap can also be worn on the belly instead of the back, with the upper backrest 24 and a lower backrest 25 of the harness 22 now resting on front side of the user.

Figure 5:
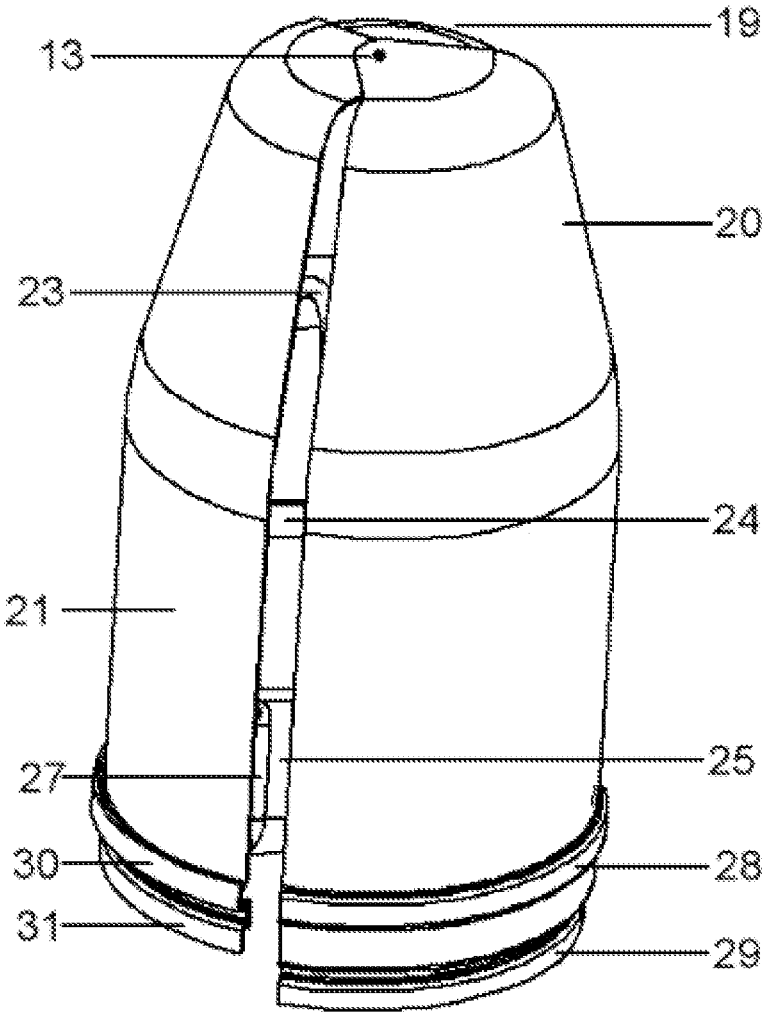

FIG. 5 shows the protective cap of FIG. 4, with the outer part 20 and the middle part 21 are turned forward about the vertical axis 13 and in this way form a completely closed compartment with the inner part 19 at the rear of the protective cap.

The undersides of the outer part 20 and the middle part 21 include a guidance system to allow both parts to turn smoothly about the vertical axis 13 and to give extra strength to the construction. The outer part 20 includes protrusions 28 and 29. The inner part 19 and the middle part 21 include similar protrusions 28 and 29 (not shown here). On the the latter protrusions of the middle part 21 are guidance strips 30 and 31 attached, which can slide into similar guidance strips of the inner part 19.

Figure 6:
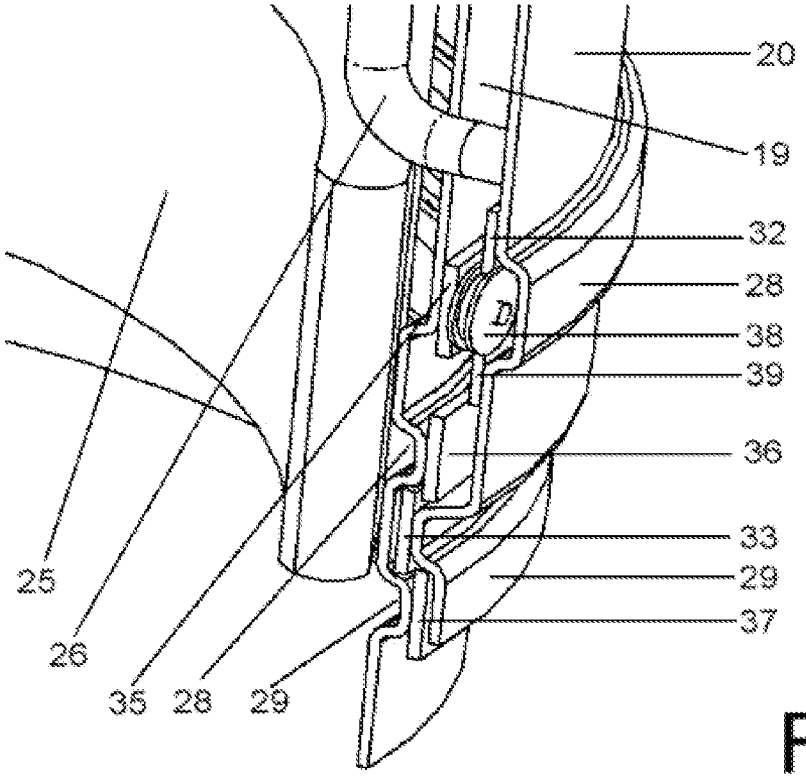

FIG. 6 provides a detailed view of a preferred embodiment of this guidance system for the outer part 20 in the open configuration of FIG. 4. The inner part 19 comprises protuberances 28 and 29 with guidance strips 36 and 37 attached thereto. The inside of the outer part 20 comprises a protuberance with a guidance strip 33 mounted thereon such that the guidance strip 33 is clamped between the guidance strips 36 and 37 of the inner part 19.

The inner part 19 in this embodiment also comprises a guide wheel 38 in a holder 35. In this guide wheel 38 a guide strip 32, which is attached to the inside of the part 20, can move without friction. The guide wheel 38 can be implemented as ball bearing shaft which is rigidly attached to the holder 35. In FIG. 6 one end of a guidance strip 39 is shown. The outer part 20 includes on it opposite end of this guide strip 39 is a similar guide wheel 38, which rolls over the guide strip 36 of the center cap 19 (not shown here). The middle section 21 includes a similar guidance system as shown here.

It will be apparent to the skilled person that the inventive concept allows a wide application and is certainly not limited to the given embodiments, which serve only by way of illustration.

The invention claimed is:

1. Protection shield, which can be worn by one person, the protection shield comprises: an inner and an outer concentric hollow semi-cylindrical halves, which are in one configuration nested on top of each other and the outer half is rotatable about 180 degrees with respect to the inner half to form a closed compartment, so that the wearer's upper body is completely enclosed and wherein the inner and outer halves are made of unbreakable material.

2. Protection shield, which can be worn by one person, the protection shield comprises: a plurality of concentric hollow semi-cylindrical members which are nested on one another in one configuration and which can be rotated with respect to one another such that a closed compartment is created, so that the upper body of the wearer is entirely enclosed and wherein the members are made of unbreakable material.

3. Protective shield according to claim 1, wherein each one of the inner and outer halves includes a telescopically retractable hollow semi-cylindrical panel.

4. Protective shield according to claim 1, wherein at least one of said inner and outer halves include harness on an inner surface thereof, that can be strapped to the wearer of the shield.

5. Protection shield according to claim 4, further comprising a harness with looped shoulder rests, to keep the shield on shoulders of the wearer.

6. Protective shield according to claim 4, wherein the harness is mounted on the inner half.

7. Protective shield according to claim 1, wherein said inner and outer halves comprises a frame that provides free space for mounting bullet-resistant panels.

8. Protective shield according to claim 1, wherein upper part of at least one of said inner and outer halves comprises a viewing window, which is made of bullet resistant material.

9. Protective shield according to claim 1, wherein each of the inner and outer halves comprises at least one circular segment-shaped curved guide and wherein the circular segment-shaped curved guide of the inner half slides into the circular segment-shaped curved guide of the outer half for a precise smooth mutual rotation.

10. Protection shield according to claim 9, wherein the circular segment-shaped curved guide of one of the inner and outer halves is configured to roll on a ball-bearing which is fixedly attached to an edge of the other one of the inner and outer halves.

11. Protective shield according to claim 2, wherein each of the hollow semi-cylindrical members comprise at least one circular segment-shaped curved guide and wherein the circular segment-shaped curved guides of the members are sliding into one another for a precise smooth mutual rotation.

* * * * *